United States Patent [19]

Culbertson

[11] Patent Number: 4,732,103

[45] Date of Patent: Mar. 22, 1988

[54] METHOD OF CONVERTING AN OCEAN CARGO BARGE INTO AN OFFSHORE MANNED SERVICE BARGE

[75] Inventor: John C. Culbertson, Houston, Tex.

[73] Assignee: Martech International, Inc., Houston, Tex.

[21] Appl. No.: 791,573

[22] Filed: Oct. 25, 1985

[51] Int. Cl.[4] ..... B63B 9/00

[52] U.S. Cl. ..... 114/65 R; 114/71; 52/79.1

[58] Field of Search ..... 114/65 R, 71, 77 R, 114/77 A, 189, 89, 90, 365, 352, 94–96; 440/39; 52/79.1–79.9; 116/26, 173

[56] References Cited

U.S. PATENT DOCUMENTS

| | | | |
|---|---|---|---|
| 2,285,590 | 6/1942 | Larson | 114/365 |
| 2,368,441 | 1/1945 | Bedford | 114/65 R |
| 3,011,252 | 12/1961 | Svensson | 114/65 R |
| 3,363,597 | 1/1968 | Zeien | 114/65 R |
| 3,476,929 | 11/1969 | Klinger | 116/173 |
| 3,727,753 | 4/1973 | Starr et al. | 52/79.7 |
| 3,855,743 | 12/1974 | Wokas | 52/79.1 |
| 3,941,076 | 3/1976 | Rice | 440/39 |
| 4,091,581 | 5/1978 | Abbott | 52/79.1 |
| 4,255,912 | 3/1981 | Kovacs | 52/79.8 |
| 4,476,798 | 10/1984 | Backus | 114/77 R |

FOREIGN PATENT DOCUMENTS

| | | | |
|---|---|---|---|
| 2088292 | 6/1982 | United Kingdom | 114/71 |

*Primary Examiner*—Joseph F. Peters, Jr.
*Assistant Examiner*—Stephen P. Avila
*Attorney, Agent, or Firm*—Bernard A. Reiter; Mark G. Bocchetti

[57] ABSTRACT

The present invention is directed to a method of rapidly and inexpensively converting an ocean deck or cargo barge so that it may be used as a U.S. Coast Guard approved manned service and construction barge. This is accomplished by providing the cargo barge with modular components mounted to the deck of the barge. Such modular components include crew living quarters modules, a kitchen module, a mess module, storage module and a central services module. The central services module functions to distribute the utilities required for manned use. Such utilities include electrical power, potable water and fire water. The barge is also provided with generators, fuel tanks, bulk storage potable water tanks and a crane. The method of the present invention provides an inexpensive and efficient method for rigging and derigging ocean deck barges for use as manned service and construction barges thereby making such vessels more readily available than ever before at a fraction of the cost of those service and construction vessels currently in use.

8 Claims, 4 Drawing Figures

METHOD OF CONVERTING AN OCEAN CARGO BARGE INTO AN OFFSHORE MANNED SERVICE BARGE

BACKGROUND OF THE INVENTION

1. FIELD OF THE INVENTION

The invention relates to offshore construction and repair work such as for example, the work which takes place on underwater pipelines, risers, oil and gas drillng operations and the platforms from which such operations are conducted. More specifically, the invention pertains to the economic use of unmanned hulls which reside in multitudinous numbers around the world in the form of sporadic or infrequently used unmanned barges.

2. BRIEF DESCRIPTION OF THE PRIOR ART

The offshore gas and oil exploration and drilling industry is known to be historically cyclical over years, and, in addition, seasonal. Moreover, the pursuit of oil and gas reserves, offshore particularly, is notoriously expensive because of the need to transport equipment on floating vessels and to carry out all exploration and petroleum retrieval operations from the deck of such vessels or from the deck of platforms build adjacent such vessels. Thus the cost of petroleum retrieval offshore are not only expensive but the success is unpredictable, and the frequency of work sporadic. Under such circumstances, it is readily apparent that the acquisition of equipment is risky since there is little predetermined confidence that the equipment will be continuously employed over the period of time necessary to amortise the investment therein. One such piece of equipment characterized by substantial, if not the most substantial investment in offshore oil and gas operations, is the service barge itself. Construction and service barges typically are among the largest pieces of equipment used in offshore construction work. These barges exist in a range of THREE HUNDRED AND FIFTY (350) ft. in length and cost upward of FOUR to FIVE MILLION DOLLARS ($4,000,000.00 to $5,000,000. 00). Therefore, cyclical drilling and/or offshore maintenance operations expose owners of offshore diving and construction barges to substantial risk of financial loss.

In recent years, efforts have been made to develop faster methods of construction ships and vessels of all types thus reducing the time and related cost of constuction. Although assembly-line ship building methods have been developed where separate sections of the ship are prefabricated and assembled, such as for example, as shown in U.S. Pat. Nos. 2,368,441 and 3,011,252, there is insufficient savings to nevertheless fabricate barge hulls having the necessary internal bracing and structural integrity at a cost effectively within the rate of return barge owner-operators require in cyclical usage.

SUMMARY OF THE INVENTION

Accordingly, it is an object of the present invention to provide a method of converting a typical unmanned ocean deck barge into a U.S. Coast Guard approved manned service and construction barge.

Another object of the present invention is to provide a method in which the conversion of the barge from manned to unmanned status is accomplished by the attachment/reval of a plurality of functional modules whereby assembly and disassembly can be accomplished in a relatively short period of time without violation of the physical integrity of the hull/deck, thereby enabling multi-utilization of the basic hull/deck structure of a vessel over extended time periods.

A further object of the present invention is to provide a method which will allow the use of an unmanned offshore deck barge as a manned service and construction barge.

A still further object and principle advantage of the invention resides in a remarkably less expensive method for providing a service barge for offshore use. Moreover, it can be provided for use in a fraction of the time normally taken to construct such a vessel.

Briefly stated, the foregoing and numerous other features, objects and advantages of the present invention will become readily apparent upon reading the detailed description, claims and drawings set forth hereinafter. These features, objects and advantages are accomplished by converting an unmanned offshore deck barge into a manned service and construction barge by the installation of modular components upon the deck of the barge. These modular components will allow the barge to be used as a manned service and construction barge and meet the requirements of the U.S. Coast Guard for use as a manned service and construction barge.

The conversion of an unmanned deck barge to a manned service barge requires numerous modifications to the barge which, in the past, would cause great expense. A permanent conversion would cost on the order of FOUR to FIVE MILLION DOLLARS ($4,000,000.00 to $5,000,000.00). This expense often cannot be justified because of the limited and cyclical need by individual contractors for such a barge. Its lack of full time utilization makes the price tag prohibitive. This expense is obviated by the construction of modularized components specifically designed for mounting to the deck of a typical unmanned barge. Once these modular components are attached to the deck of an unmanned barge, such barge will contain all of the facilities necessary and/or required by the U.S. Coast Guard for use as a manned service barge.

It is envisioned that each modular component will be skid or plate mounted to facilitate relatively quick and easy attachment of the modules to the deck of the barge. Actual connection of the support plates or skids to the module may accomplished by pin or bolt or other such mechanical means as would enable substantially instant connect/disconnect type coupling. Other types of mechanical couplings, such as clamps, over-center cam type lever couplers and/or turn buckles would be appropriate, provided they constitute a mechanical coupling means enabling quick connect/disconnect ability with substantially conventional hand tools or the like and further provided there is no physical intrusion into the integrity of the hull/deck of the vessel such as would be characterized by internal structural bracing and super structure modifications.

A variety of different modules means would be provided and mounted to the deck of the barge, each having a specific function or purpose. Among such modules there are contemplated module means having self contained air conditioning and heating, water, shower and laboratory facilities. Each such sleeper module means provides complete living quarters for a plurality of men. Further, there is provided a galley module means which shall contain a stove, oven, freezer, refrigerator, sinks, air conditioning and heating, water heater and counter tops and such other functional features as are appropriate. The galley module means may also have therein a small ships office plus ship stores in quantities dictated by the number of personnel and the length of the working project offshore.

Of significant import and novelty is the central services module means in which there is, among other equipment, contained an electrical switchboard from which power can be distributed throughout the barge. Associated with the central services module means is the prime power generator, which also is craned onto the deck of the barge and appropriately affixed to the vessel in electrical communication with the central services module means. Also there may be contained in the central services module means a potable water tank with potable water pumps for supplying fresh water where needed on the barge. Further, there is contained within a central services module, a fire water pump and such other emergency equipment as may be desired. This module is also provided with a fire water suction manifold and a fire water discharge manifold. Other equipment may be contained in the central services module means such as tubs, work benches, storage lockers and appropriate lighting. It is the intention hereof that the central services module means shall contain such necessary though varied, equipment and provisions as are appropriate for the particular work to be done offshore, and that as many of such man-subsistance necessities as possible, shall be contained in the unitary-central service module means. This central service module means, like the other module means shall be craned into position onto the vessel deck. There pre-positioned mechanical locking means, such as the aforementioned locking nuts, over-center cam type lock means, or the like, are actuated to quickly and easily affix the modules in position and lock them into place. Approved safety fire station equipment are mounted for easy access on an external wall of the module. The central services module supplies all of the utilities necessary to allow U.S. Coast Guard approval of the barge for manned use.

Also mounted in modular fashion to the deck of the barge are diesel generators, diesel fuel tanks, crews mess and lounge unit and that equipment necessary to make the barge useful as a construction barge, such as, a crawler type crane, mooring winches and the like.

BRIEF DESCRIPTION OF THE DRAWINGS

FIG. 5 is a partial elevation of the mast at Section A—A of FIG. 1.

DETAILED DESCRIPTION OF THE PREFERRED EMBODIMENT

Figure 1:
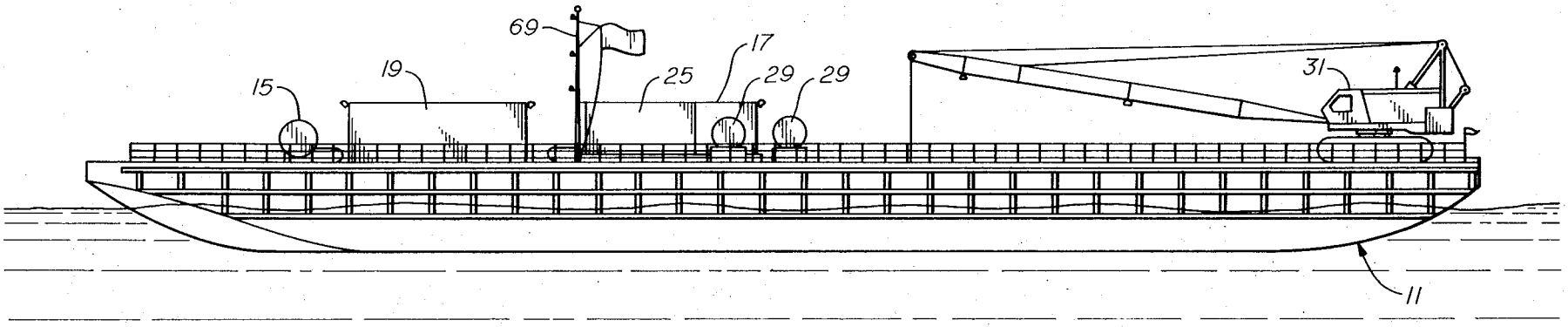
FIG. 1 is a side elevation of an unmanned offshore deck barge converted for use as a manned service and construction barge by the installation of modular components on the deck of the barge.
Figure 2:
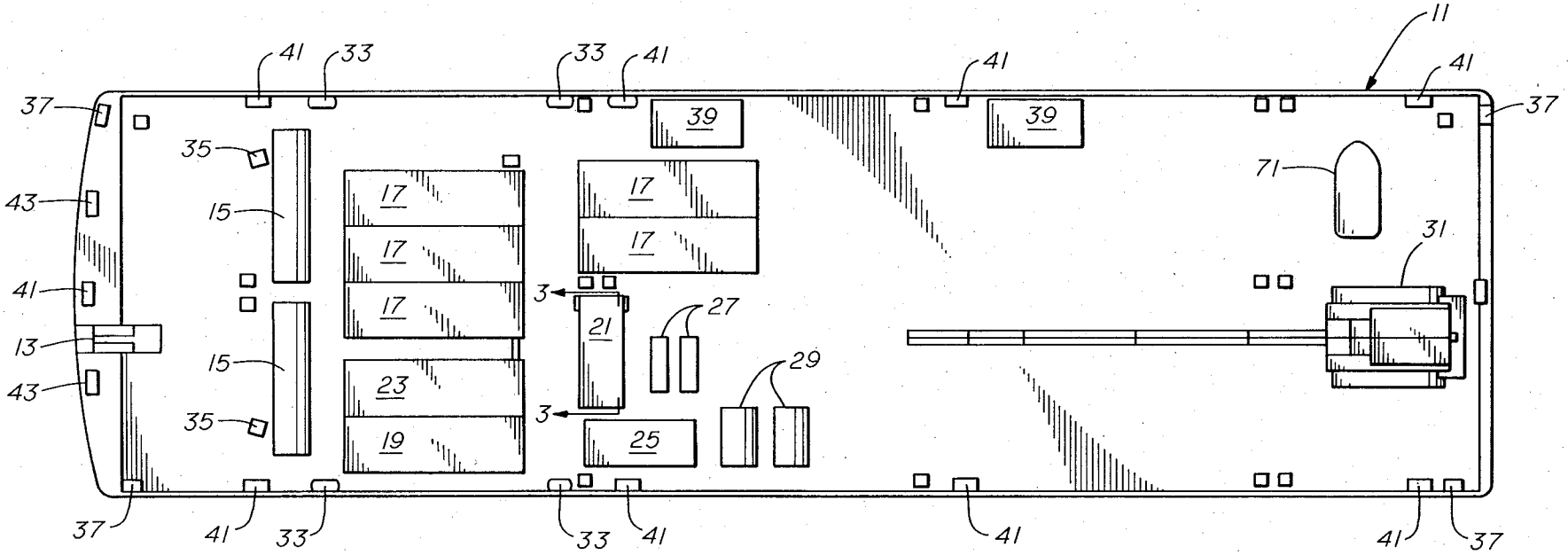
FIG. 2 is a plan view of the barge.

Referring now to the drawings, there is shown in FIGS. 1 and 2 a typical ocean deck barge 11 U.S. Coast Guard inspected of ABS Class. The deck barge includes an anchor 13.

Mounted to this typical unmanned deck barge 11 to make it usable as a manned service and construction barge are a variety of modular components. Included in such modular components are potable water tanks 15, crews sleeper modules 17, galley module 19, central services module 21, crews mess and lounge 23 and storage module 25.

Each sleeper or crew living quarters module 17 is equipped with lockers and bunks for a plurality, such as, eight men, sink, toilet, shower, water heater and central air conditioning and heating unit. The crew mess 23 is equipped with a range with hood, freezer, refrigerator, sink, water heater, cabinets, shelving, tables, chairs, and central air conditioning and heating. The lounge module 19 contains a small lounge area for watching TV as well as a mini kitchen area. Also included in the lounge module 19 is a small office and a laundry area containing washers, dryers, a wash tub and a water heater.

Proximately located to the central services module 21 are diesel generators 27 which supply power to the barge through the central services module 17 as later herein discussed. Fuel is supplied to the generators 27 by means of diesel fuel tanks 29.

The modules and equipment heretofore discussed are preferably mounted to the barge amidship and forward. Such arrangement leaves the aft portion of the barge 11 open for the mounting of a crawler type crane 31 in fixed position.

Twenty man ocean type U.S. Coast Guard approved life rafts 33 are positioned in drums about the periphery of the living quarters section of the barge 11. The barge 11 is also equipped with towing chock 35 and roller type fair lead chocks 37 for mooring wires. Mooring winches 39 for 4-point mooring are provided at each end of the barge. Double bitts 41 are positioned about the periphery of the barge 11. The barge 11 is also supplied with closed chocks 43 located at the forward end of the barge 11 for receiving rope from the towing chock 35.

Figure 3:
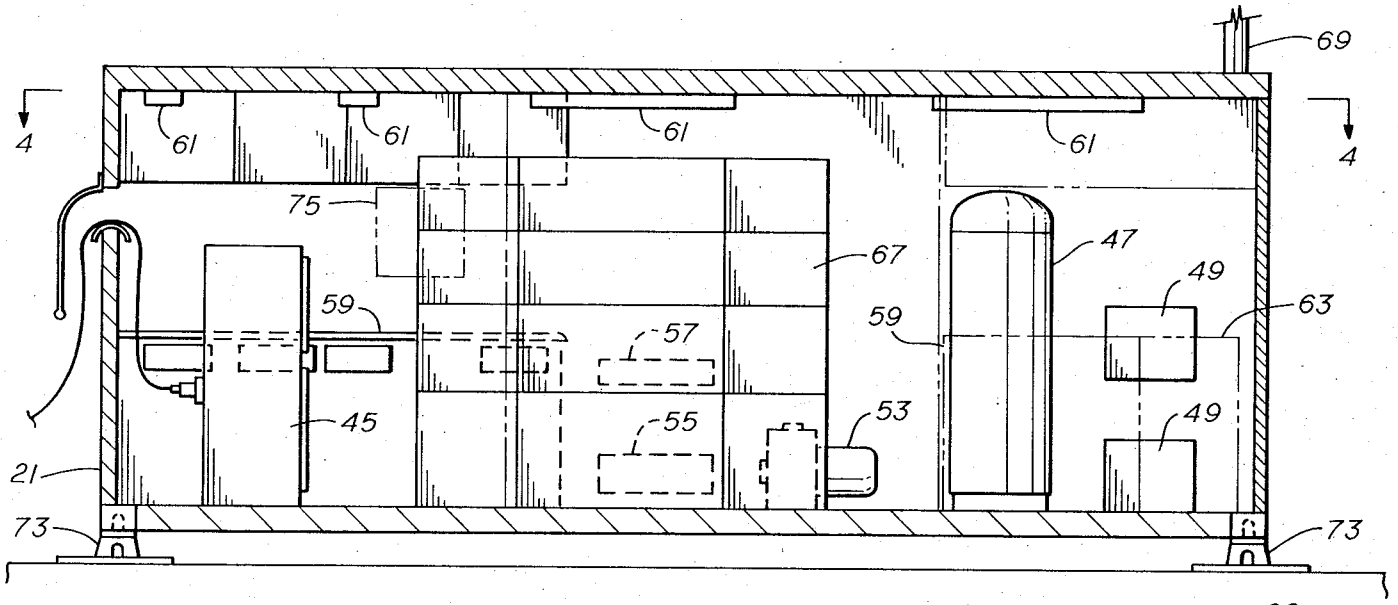
FIG. 3 is a side elevation of the central services module.
Figure 4:
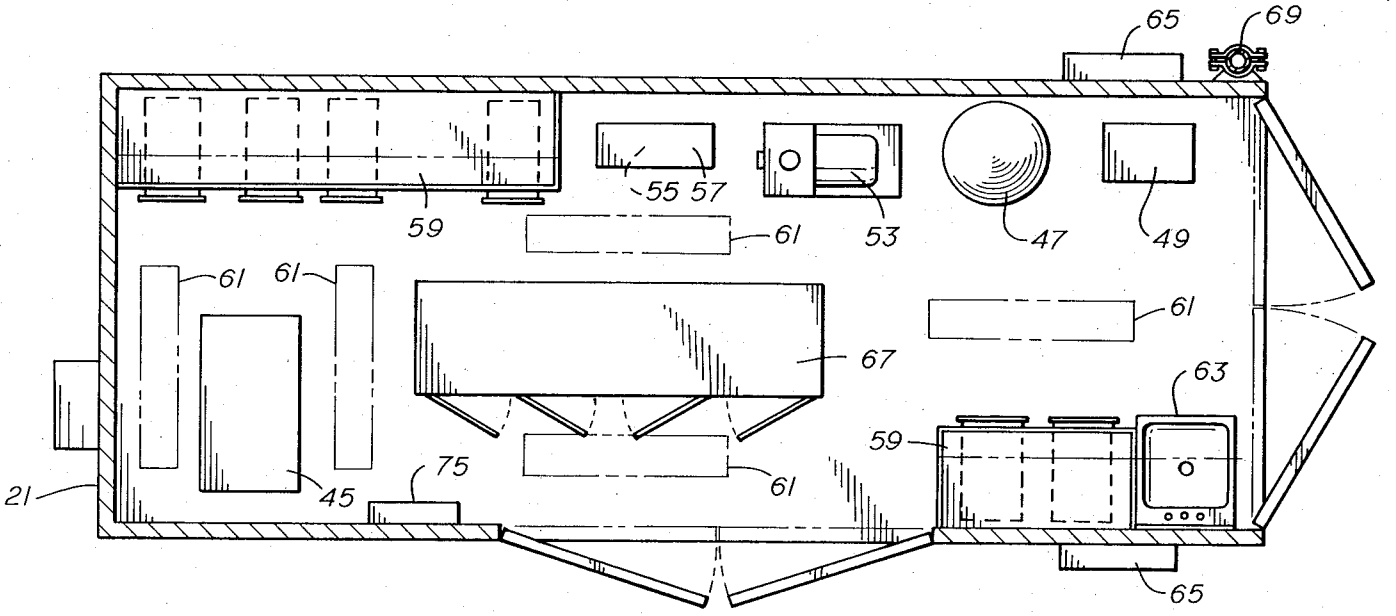
FIG. 4 is a plan view of the central services module.

A key factor in obtaining U.S. Coast Guard approval of a typical ocean deck barge for use as a manned service barge is the ability to properly supply all of the necessary utilities for construction and living purposes. This is accomplished with the central services module 21 shown in detail in FIGS. 3 and 4. Contained within the central services module 21 is an electrical switchboard 45. The electrical switchboard 45 is used to distribute power throughout the barge for all required uses. Power is delivered to the switchboard from generators 27.

Also contained within the central services module 21 is a potable water system for supplying potable water to the crew for drinking, hygiene and laundry. This potable water system consists of pressure tank 47 and potable water pumps 49. Potable water tanks 49 deliver water to pressure tank 47 and take suction from potable water storage tanks 51 also mounted to the deck of barge 11. The main potable water supply line from pressure tank 47 is provided with a threaded union type coupling located just outside the wall of the central services module for easy coupling and uncoupling of the piping necessary to deliver fresh water where needed on the barge.

Also contained with the central services module 21 is a fire water system consisting of fire water pump 53, fire water suction manifold 55 and fire water discharge manifold 57. Fire water suction is taken from the sea. Fire water discharge valving is preferably located just outside the central services module 21 and designed to receive standard quick connect type fire water hoses.

The central services module 21 is also supplied with work benches 59 with overhead lockers, lighting 61 and wash tub 63. Mounted externally to the walls of the central services module 21 are cabinets 65 which contain additional safety fire station equipment for easy access. The central services module is also provided with storage lockers 67.

A mast 69 is attached to the central services module. Extending from the mast 69 are yard arms 71 from which day shapes 73 may be displayed.

From the foregoing it can be seen that the present invention provides for the rapid outfitting and deployment of a conventional ocean deck barge so that it may be used as a U.S. Coast Guard approved construction service barge. Similarly, due to the fact that all modules and equipment used in the present invention are deck mounted, the derigging of the deck barge is also rapid and inexpensive. Many of the modules discussed herein, such as the living quarters module 17 and the crews mess module 23 can be rented or purchased in complete and usable form. It is, however, necessary to construct and properly outfit the central services module 21 which is the heart of the barge conversion. Having a central services module in storage and ready for use and either purchasing or renting the other modules and equipment described herein will allow the conversion of a typical ocean deck barge to a construction service barge in a matter of days. Similarly, it will also be a matter of days to derig such a barge when its services are no longer needed. The user of the conversion method of the present invention will experience tremendous cost savings. In fact, the daily rental cost of a bare ocean deck barge and all of the modules and equipment necessary for conversion will only amount to approximately one-third the daily rental cost of a fully rigged out construction service ship. This includes the daily rental cost of a tug boat to tow the converted barge to and from its work location.

Past permanent conversions of cargo barges to manned service barges have cost on the order ot TWO to THREE MILLION DOLLARS ($2,000,000.00 to $3,000,000.00). Such barges necessarily lay dormant much of the time and therefor represent a tremendous cost burden. As stated previously, the construction of a service and construction ship from the ground up would cost on the order of FOUR to FIVE MILLION DOLLARS ($4,000,000.00 to $5,000,000.00). It can be seen that the method of the present invention provides to the user a means for obtaining a service and construction barge at a fraction of past costs. Further, the construction service barge is only in existence for the times that it is needed to perform its function. At all other times, it is derigged and returned to the barge leasing company.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method of rapidly and economically converting an unmanned ocean cargo barge to a manned service and construction barge comprising the steps of:

a. mounting to the deck of the cargo barge a central services module having electrical controls, water systems and other manned utilities for distributing power and utilities therethrough;

b. affixing to the deck of the barge a plurality of living quarters modules thereby providing the crew with complete sleeping and bathroom facilities;

c. attaching to the deck of the barge a kitchen module to provide the barge with a food preparation and storage area; and d. installing interconnecting piping and wiring from said central services module to said living quarters and kitchen modules.

2. A method of rapidly converting an unmanned ocean cargo barge to a manned service and construction barge as recited in claim 1, further comprising the steps of:

a. connecting to the deck of a barge a generator to supply power to the barge;

b. fastening to the deck of the barge fuel tanks to provide fuel to said generator; and c. adding to the deck of the barge a crane for use in the construction and service operations to be performed by the barge.

3. A method of rapidly converting an unmanned ocean cargo barge to a manned service and construction barge as recited in claim 2, further comprising the steps of:

a. providing the barge with a plurality of ocean type U.S. Coast Guard approved life rafts;

b. adjoining to the deck of the barge a crews mess and lounge module; and c. appending to the deck of the barge a potable water storage tank.

4. A method for converting an unmanned ocean cargo barge to a manned service and construction barge as recited in claim 3, further comprising the step of: erecting a mast with yard arms from said central services module for displaying day shapes and flags.

5. A central services module for use in a method of converting an ocean cargo barge to a manned service and construction barge comprising:

a. an enclosed container having door access thereto;

b. an electrical switchboard mounted within said container for distribution of electrical power to the barge;

c. a potable water pump with a pressure tank installed within said container for supplying potable water to the barge;

d. a fire water pump within said container taking suction directly from the sea; and e. a fire water discharge manifold connected to said water pump to provide an easy access fire water pumping station mounted externally to said container.

6. In a method for rapidly and economically converting an unmanned ocean cargo barge to a manned service and construction barge and for reconverging said manned service and construction barge back to an unmanned ocean cargo barge, selectively, and periodically, so as to enable optional use of the vessel in the most expeditious fashion comprising the steps of:

a. removably affixing to the deck of the cargo barge a central services module means for distributing electrical and other utilities means necessary for human consumption and manpower subsistance;

b. removably affixing to the deck of the barge a plurality of living quarters in module form and containing bunk means and other subsistance apparatus such as water supply and lights and thereby providing a crew with sleeping, bathing and bathroom facilities;

c. detachably affixing to the deck of the barge a kitchen module means for storing food and enabling the preparation and servicing of the crew with respect thereto; and d. removably installing interconnecting piping and wiring from said central services module to said living quarters and kitchen modules thereby enabling manned utilization of the ocean barge for contruction barge service purposes while providing for reconversion thereof to unmanned ocean cargo barge usage without experiencing structural modification to the cargo barge or diminishment of the hull integrity thereof.

7. In a barge characterized by a hull and deck thereon alternately usable for manned or unmanned operations in which the unmanned operations include utilization of the hull and deck as a cargo carrying means adapted to be moved by external motive power and in which the manned operations include conversion of the hull and appended deck to comprise the following:

a. a central services module means removably affixed to the barge for providing electrical, plumbing and other human subsistance facilities;

b. a plurality of living quarters module means for occupation by the crew manning the barge and enabling sleeping and other human subsistance needs;

c. means for removably and for expeditiously mounting and/or removing the central services module means and living quarter module means to or from the barge in minimal time through the use of hand tools or the like and without violation of the physical integrity of the barge and/or deck thereof; and d. interconnecting piping and wiring coupling said central services module means to appropriate facilities in said living quarters modules and kitchen modules to thereby enable continued subsistance by personnel on board of said construction barge while enabling facile removal of said various module means without violation of the physical integrity of the barge, so that it may be used as a cargo barge periodically, thus optimizing overall utilization of the hull-deck structure during long term periods.

* * * * *